US006729640B1

(12) United States Patent
Sedlmair et al.

(10) Patent No.: US 6,729,640 B1
(45) Date of Patent: May 4, 2004

(54) DEVICE FOR INFLUENCING FLEXING MOVEMENTS OF A SKI

(75) Inventors: Gerhard Sedlmair, Farchant (DE); Ludwig Wagner, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 0 days.

(21) Appl. No.: 10/069,217

(22) PCT Filed: Aug. 2, 2000

(86) PCT No.: PCT/DE00/02582

§ 371 (c)(1),
(2), (4) Date: Jul. 8, 2002

(87) PCT Pub. No.: WO01/14023

PCT Pub. Date: Mar. 1, 2001

(30) Foreign Application Priority Data

Aug. 25, 1999 (DE) ..... 199 40 182

(51) Int. Cl.[7] ..... A63C 5/07
(52) U.S. Cl. ..... 280/602; 280/607
(58) Field of Search ..... 280/602, 607, 280/601, 634, 633, 618

(56) References Cited

U.S. PATENT DOCUMENTS

| | | | | |
|---|---|---|---|---|
| 3,937,481 A | | 2/1976 | Koleda | |
| 5,046,751 A | | 9/1991 | Scherübl | |
| 5,251,923 A | | 10/1993 | Stepanek et al. | |
| 5,269,555 A | * | 12/1993 | Ruffinengo | 280/602 |
| 5,301,976 A | * | 4/1994 | Stepanek et al. | 280/602 |
| 5,320,377 A | * | 6/1994 | Ruffinengo | 280/602 |
| 5,421,602 A | * | 6/1995 | Stepanek et al. | 280/602 |
| 5,437,468 A | | 8/1995 | Schenner | |
| 5,551,720 A | | 9/1996 | Ruffinengo | |
| 5,924,717 A | | 7/1999 | Janisch et al. | |

FOREIGN PATENT DOCUMENTS

| | | | |
|---|---|---|---|
| DE | 92 01 845.9 | | 3/1993 |
| DE | 91 16 875 U1 | | 4/1994 |
| WO | 93/01869 | | 2/1993 |
| WO | WO 94/08669 | * | 4/1994 |

OTHER PUBLICATIONS

U.S. patent application Publication 2002/0093174—dated Jul. 2002.*

* cited by examiner

*Primary Examiner*—Bryan Fischmann
(74) *Attorney, Agent, or Firm*—D. Peter Hochberg; Sean Mellino; Katherine R. Vieyra

(57) ABSTRACT

A thruster (2) arranged in the longitudinal direction of the ski has a section which is fixed to the ski and an area (3) which is located at a distance from said thruster and which can be moved in a longitudinal direction of said ski and which is coupled to an abutment, which is also fixed to the ski by means of a hydraulic damper (10) via a hydraulic suspension (10). In order to enlarge the lifts of the damper (10), a multiplication gear is located between the damper (10) and the movable area (3), more particularly in the form of a lever gear (6).

5 Claims, 2 Drawing Sheets

DEVICE FOR INFLUENCING FLEXING MOVEMENTS OF A SKI

CROSS REFERENCE TO RELATED APPLICATION

This application is the National Stage of International Application No. PCT/DE00/02582 filed Aug. 2, 2000.

BACKGROUND OF THE INVENTION

1. Field of the Invention

This invention relates to a device for influencing the flexing movements of a ski, having a thruster part which is arranged and can be mounted in the longitudinal direction of the ski and which has an area that is located at a distance from said thruster part and can be displaced in a longitudinal direction of the ski and is or can be coupled to an abutment which is or can be secured on the ski by means of a force transmission means.

2. Description of the Prior Art

Some of these devices for influencing the flexing movements of a ski have already been integrated as standard equipment into ski bindings, where the device, a thruster part, is designed to be flexed like a flat strip, one end of the flat strip being secured on the ski beneath the ski binding unit on the heel end, and the other end, which is movable in the longitudinal direction of the ski, being guided in guides secured on the ski beneath the part of the ski binding near the toes. As soon as the ski executes flexing movements, the forward end of the thruster part, which is like a flat strip, is displaced in the longitudinal direction of the ski relative to the top side of the ski, because the thruster part is outside the neutral flexing zone of the ski. With greater bending of the ski, the forward end of the thruster part is supported with flexible tongues on an adjustable abutment on the ski, with the result that the ski is reinforced in a controllable manner.

The object of this invention is to create a design for a device that can be easily adapted to different force transmission means in the case of a device of the type having a thruster part which can be attached or mounted in the longitudinal direction of the ski and having an area or part which is located at a distance in the longitudinal direction of the ski from said thruster part, the area can be displaced in the longitudinal direction of the ski, and can be coupled or attachable to an abutment that can be mounted fixedly on the ski by means of force transmission means.

SUMMARY OF THE INVENTION

This object is achieved according to this invention by the fact that a transmission device is connected between the force transmission means and the displaceable area, transmitting the motion lifts of the displaceable area relative to the ski to the force transmission means with a predefined or predefinable transmission ratio.

This invention is based on the general idea of varying the distance of the effective displacement lift of the displaceable area of the thruster part through a pivotal lever arrangement to permit an optimum adaptation to the respective force transmission means.

This is especially important and advantageous if a hydraulic damper is in effect between the displaceable area of the thruster part and the abutment secured on the ski. Such dampers can be tuned much more easily if there are large lifting movements. Accordingly, this invention is used with hydraulic dampers to convert the lifts of the displaceable area of the thruster part into enlarged lifts of the shock absorber.

BRIEF DESCRIPTION OF THE DRAWINGS

Moreover, with regard to preferred features of this invention, reference is made to the claims and the following description of the drawings, on the basis of which especially preferred embodiments of this invention are described in greater detail.

The drawings show.

DETAILED DESCRIPTION OF THE PREFERRED EMBODIMENT

Figure 2:
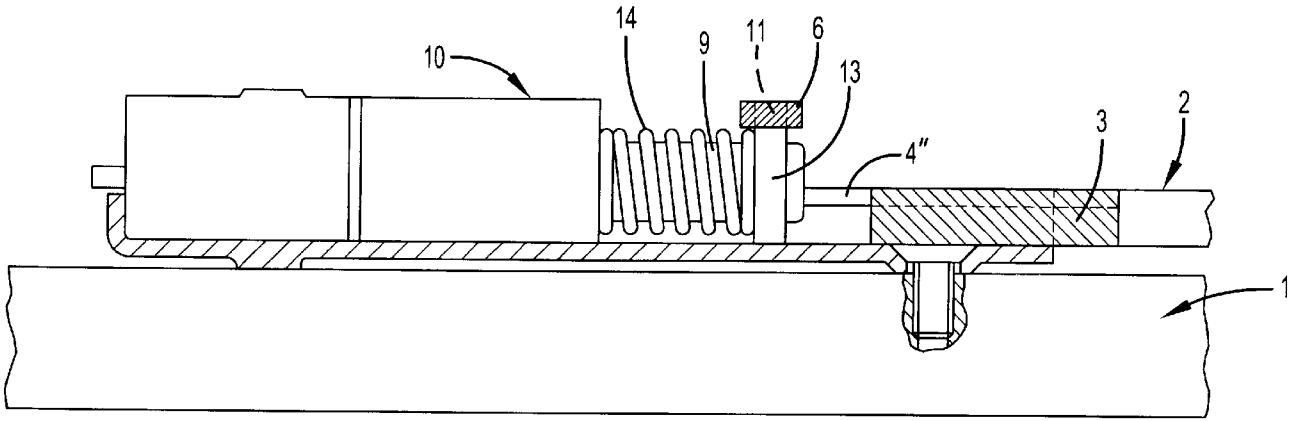
FIG. 2: a sectional diagram according to sectional line II—II in FIG. 1.
Figure 1:
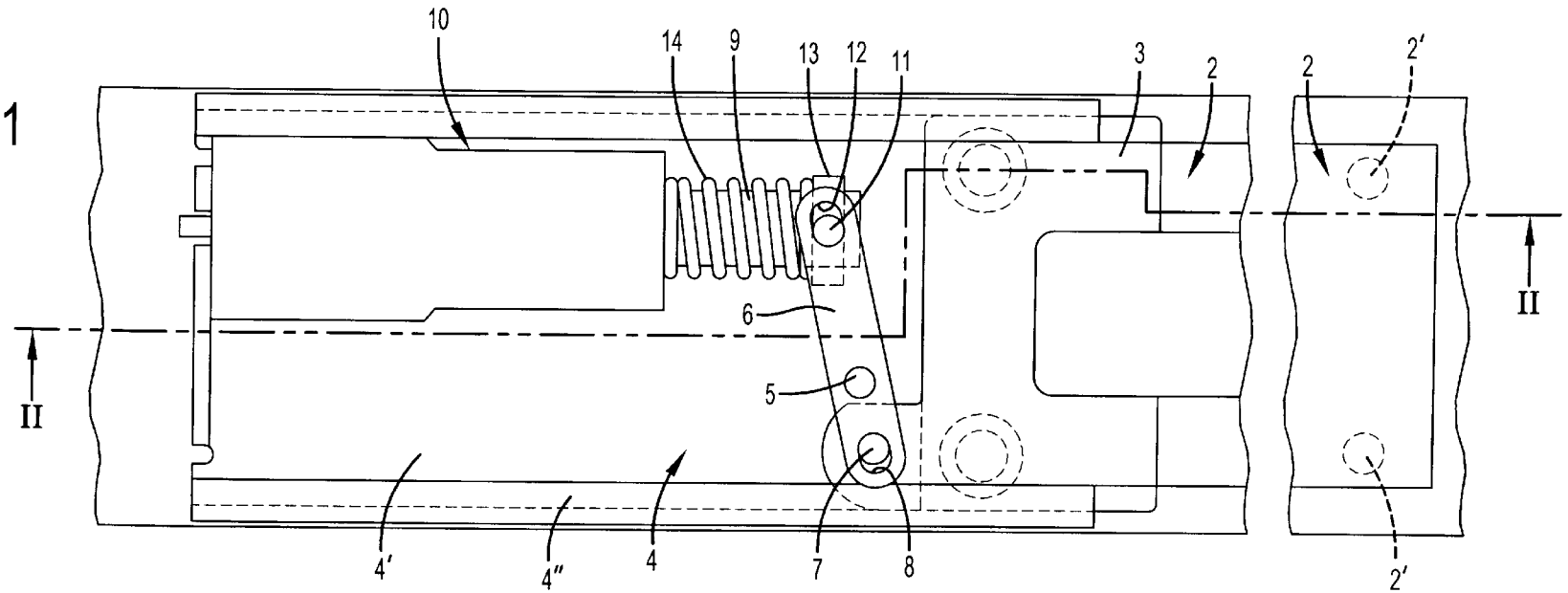
FIG. 1: a schematic top view of a first embodiment.

In the embodiment in FIGS. 1 and 2, a thruster part 2 like a flat strip is arranged on the top side of a ski 1, with the right end of the thruster part 2 in the drawing being secured on the ski, e.g., by attaching it onto the ski with screws 2'. The left end of the thruster part 2 in FIG. 1 is designed as a free end which is not attached to the ski and is thus displaced relative to the ski in the longitudinal direction of the ski when the ski 1 is flexed. This is due to the fact that the thruster part 2 is arranged outside the neutral bending zone of the ski 1, namely above it.

Moreover, the left free or unattached end of the thruster part 2 is connected to or designed as a movable part or slide 3 which is accommodated so that it can be displaced in the longitudinal direction of the ski in a guide 4 which is secured on the ski. This guide consists essentially of a plate 4' attached to the top side of the ski and U-shaped channels or sections 4" which are provided on the longitudinal edges of the plate 4' and are designed to face one another with their concave sides. Longitudinal edges of the slide 3 project into these U-shaped sections 4" so that the slide 3 can be moved only in the longitudinal direction of the ski.

A bearing journal 5 which is arranged on the plate 4' of the guide 4, pivotably supports a lever assembly or double-armed lever 6, having a longer arm and a shorter arm. The shorter arm of the lever 6 is connected in an articulated manner to a short arm of the slide 3, with a link pin 7 which is arranged on the slide 3 extending into an elongated hole 8 in the lever 6. The longer arm of the lever 6 is connected in an articulated manner to a push rod 9 which forms the piston rod of a hydraulic damper 10 arranged on the guide 4. A link pin 11 attached to the push rod 9 projects into another elongated hole 12 in the lever 6.

The elongated holes 8 and 12 guarantee that the lever arms of the lever 6 are capable of pivoting freely with displacement of push rod 9 and slide 3 in the longitudinal direction of the ski. A collar 13 which is arranged on the push rod 9 serves as an abutment on the push rod for a helical compression spring 14 which is concentric with the push rod 9 and whose other end is supported on the facing end of the damper 10.

When the ski 1 executes flexing movements, the slide 3 is displaced in the guide 4 in the longitudinal direction of the ski, resulting in the lever 6 executing a pivoting movement about the bearing journal 5, so that push rod 9 also moves in the longitudinal direction of the ski. Because the longer arm of the lever 6 is a great length compared to the shorter arm, the push rod 9 executes large displacement strokes in comparison with the displacement of the slide 3. This is advantageous because performance of the damper 10 is enhanced when larger displacement strokes occur.

In the example illustrated here, the push rod 9 is pulled out of the housing of the damper 10 when the ski 1 executes a flexing in which the ends of the ski move upward relative to the center of the ski. At the same time, in this type of flexing movement of the ski 1, the load on the helical compression spring 14 arranged concentrically with the push rod is released increasingly. When the ski 1 is flexed back, the push rod 9 is pushed into the damper, while at the same time the helical compression spring 14 is put under increasing tension.

With an appropriate design of the damper 10, the push rod 9 can move comparatively easily in the tension stage, i.e., with a displacement to the right in FIG. 1, whereas a greater resistance occurs with a movement in the compression stage, i.e., to the left in FIG. 1. Accordingly, there is little or no damping of flexing movements of the ski 1, while there is increased damping when the ski is bent back.

Essentially, however, a different coordination of the damper 10 is also possible, such that there is increased damping in the tension stage or such that the tension stage and the compression stage have the same damping effect. Then bending movements of the ski 1 can be damped to a greater extent or in the same amount as bending back ski 1.

Figure 3:
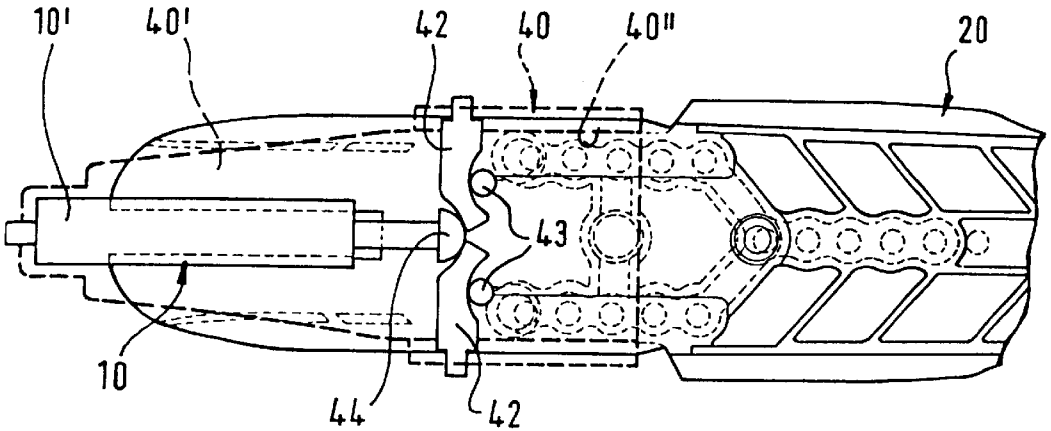
FIG. 3: a top view of the bottom side of a second embodiment.
Figure 4:
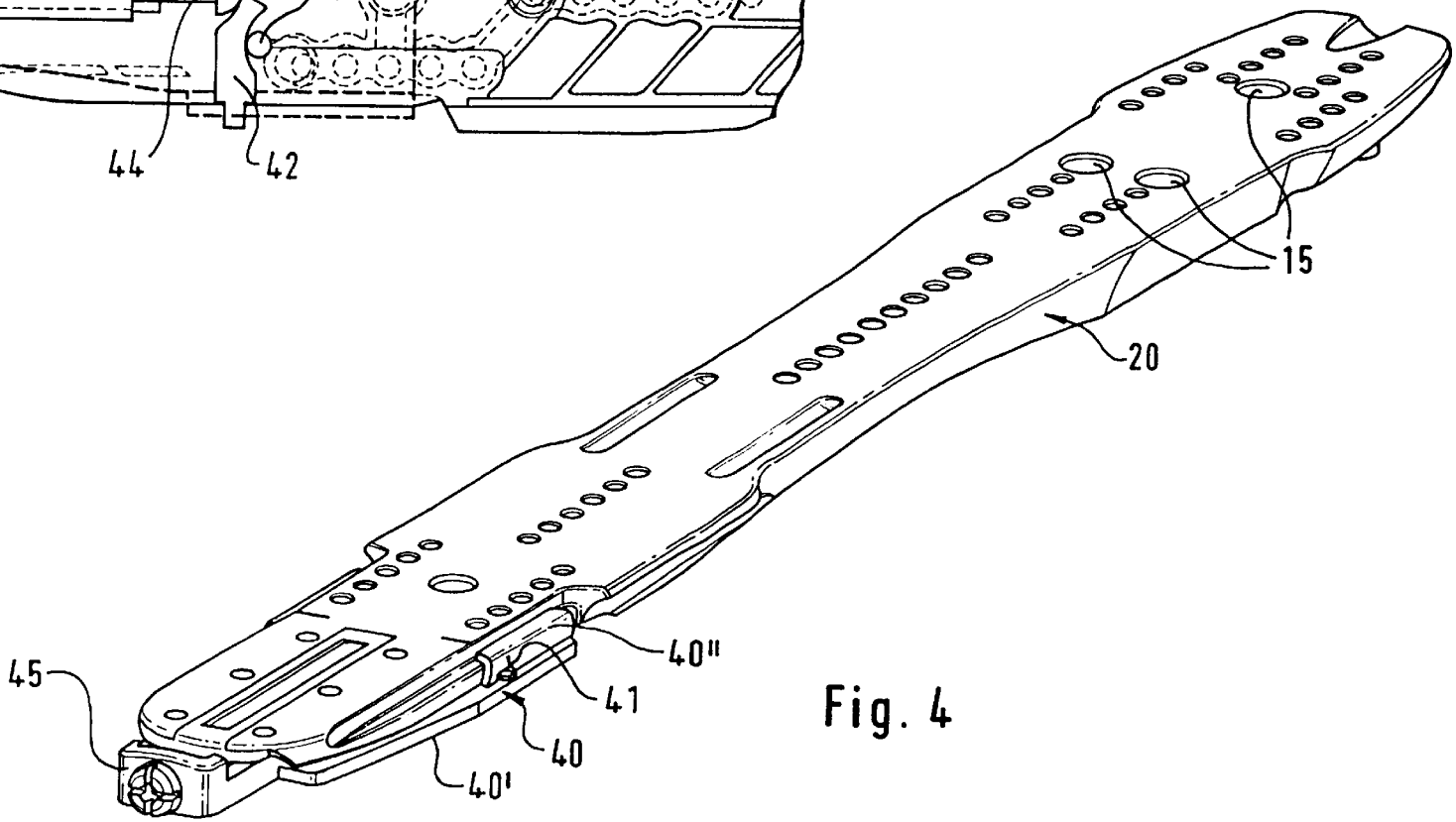
FIG. 4: a perspective view of the second embodiment.

In the case of the embodiment illustrated in FIGS. 3 and 4, the push rod is designed as a rigid standing plate 20 for a ski boot (not shown) which is held securely on the standing plate 20 by means of ski binding units (not shown) arranged on the ski on the toe end and on the heel end.

The right end of the standing plate 20 in the drawing is held securely on the ski with screws or the like which are inserted into screw holes 15 for this purpose. The left end of the standing plate 20 in the drawing is guided displaceably in a guide 40 in the longitudinal direction of the ski. The guide 40 which is fixedly arranged on the ski 1 resembles in principle the guide 4 in FIGS. 1 and 2. In addition to a plate 40' mounted fixedly on the ski, the guide 40 has lateral U-shaped sections 40" with which the standing plate 20 engages along its lateral longitudinal webs which are integrally molded on it so that they can be displaced longitudinally.

Beneath the aforementioned longitudinal webs of the standing plate 20, openings 41 are provided on the U-shaped sections 40" of the guide 40, so that rocker arms 42, which are arranged between the plate 40' of the guide 40 and the standing plate 20 and extend essentially in the transverse direction of the ski, facing one other with their free ends, engage in these openings, so that the aforementioned openings 41 form the pivot bearing of the rocker arms 42. These rocker arms may be designed as parts like flat strips having a flat strip plane parallel to the top side of the ski 1.

Projections, e.g., in the form of pegs 43, are arranged on the sides of the rocker arms 42 which face the screw holes 15 of the standing plate 20 and they are in lateral contact with each rocker arm 42 between the ends thereof.

On the side facing away from the projections or pegs 43, the rocker arms 42 are in contact at their free ends with a buffer part 44 which is arranged on the piston rod of a hydraulic damper 10 arranged in the longitudinal direction of the ski. Its damper cylinder 10' is secured in a form-fitting manner between the standing plate 20 and the plate 40' of the guide 40 in slot-like recesses in the standing plate 20 and the plate 40', with the end of the damper cylinder 10' which faces away from the buffer part 44 being supported on an abutment 45 which is fixedly connected to the guide or secured so that it can be displaced in the longitudinal direction of the ski.

Optionally a helical compression spring (not shown) which is concentric with the piston rod of the damper 10 may be arranged or stretched between the buffer part 44 and the facing end of the damper cylinder 10'.

When the ski 1 executes flexing movements, the end of the standing plate 20 which is held in the guide 40 is displaced in the longitudinal direction of the ski. Then the projections or pegs 43 press the rocker arms 42, pivoting them against the buffer part 44, so that the piston of the damper 10 is pushed into the damper cylinder 10'. Since the projections or pegs 43 act on the rocker arms 42 at a great distance from the free ends of the rocker arms 42 which are in contact with the buffer part 44, the piston rod of the damper 10 executes a motion, the measure of which is much greater than the measure of the relative displacement between the standing plate 20 and the guide 40. The measure of the stroke translation is determined by the ratio between the length of the rocker arm 42 and the distance of the respective projection or peg 43 from the pivot bearing (opening 41) of the rocker arm 42.

In deviation from the embodiment illustrated here, the rocker arms 42 may also be interconnected in an articulated manner on their facing ends, e.g., by a film joint, if the rocker arms are made of plastic according to an advantageous embodiment of this invention.

In the foregoing embodiments, the thruster part and the damper move an actual distance when the ski flexes or counterflexes (i.e. bends in both directions). The use of the device operatively interconnecting the thruster part and the damper, such as the lever 6 or the rocker arms 42, increases the effective distance a displaceable part is moved. This effective distance is greater than the foregoing actual distance. This effective distance adequately operates the damper. The effective distance is determined by a predefined or predefinable translation ratio.

The invention has been described with particular emphasis on the preferred embodiments, but variations and modifications within the spirit and scope of the invention may occur to those skilled in the art to which the invention pertains.

What is claimed is:

1. A device for influencing the flexing movements of a ski, comprising:

a thruster part fixed and extending in the longitudinal direction of the ski;

a moveable part extending from said thruster part, said moveable part moveable on the ski in the longitudinal direction of the ski in response to flexing of the ski;

a guide mountable on the ski in the longitudinal direction for receiving and limiting the movement of said moveable part in the vertical direction;

a force transmission damper attached to said guide, said damper dampening fluctuations of the flexing of the ski;

a transmission device connected between said force transmission damper and said moveable part, said transmission device comprising a device operatively interconnecting said damper and said thruster part for increasing an effective distance of movement of a displaceable part between said damper and said thruster part, said effective distance being greater than an actual distance of movement between said thruster part and said damper, and for imparting force to said damper according to said effective distance of movement;

wherein, using a predefined or predefinable translation ratio for establishing said effective distance, said transmission device transmits the movement of said moveable part to said force transmission damper.

2. The device according to claim 1, wherein:

the transmission device is a lever assembly.

3. The device according to claim 2, wherein said damper is a hydraulic damper and said lever assembly further comprises:

a double-armed lever having a first end and a second end;

a displaceable part and;

said hydraulic damper;

said lever assembly being rotatable about a pivot bearing mounted fixedly on the ski and said first end being attachable in an articulated manner to said moveable part and said second end being attachable to said hydraulic damper.

4. The device according to claim 1, wherein said damper is a hydraulic damper, said device further comprising:

at least one rocker arm having one end pivotably secured in a bearing on the ski, another end being coupled to the hydraulic damper, and a middle area couplable to said movable part.

5. The device according to claim 1, wherein:

the thruster part is a standing plate for a ski shoe, said standing plate having an area secured fixedly on the ski and an area located at a distance from said thruster part in the longitudinal direction of the ski, said plate being displaceable in said guide on the ski along the longitudinal direction of the ski.

* * * * *